US010137355B2

(12) United States Patent
Brennan

(10) Patent No.: US 10,137,355 B2
(45) Date of Patent: Nov. 27, 2018

(54) LAND PADDLE

(71) Applicant: BRENNAN INNOVATION INC., Whitehorse (CA)

(72) Inventor: Joel Leslie Brennan, Whitehorse (CA)

(73) Assignee: Brennan Innovation Inc., Whitehorse (CA)

( * ) Notice: Subject to any disclaimer, the term of this patent is extended or adjusted under 35 U.S.C. 154(b) by 0 days.

(21) Appl. No.: 15/766,747

(22) PCT Filed: Jun. 6, 2017

(86) PCT No.: PCT/CA2017/050693
§ 371 (c)(1),
(2) Date: Apr. 6, 2018

(87) PCT Pub. No.: WO2017/210787
PCT Pub. Date: Dec. 14, 2017

(65) Prior Publication Data

US 2018/0296905 A1 Oct. 18, 2018

Related U.S. Application Data

(60) Provisional application No. 62/347,523, filed on Jun. 8, 2016.

(51) Int. Cl.
*A63C 11/22* (2006.01)
*A63C 17/00* (2006.01)

(52) U.S. Cl.
CPC ..... *A63C 17/0013* (2013.01)

(58) Field of Classification Search
CPC ... A63C 17/0013; A63C 11/22; A63C 11/227; A63C 11/221; A63C 11/222; B62M 29/00; B62M 29/02; B63H 16/04; A45B 9/00; A45B 9/02; A45B 9/04; A45B 2009/007; A45B 2009/005; A45B 2200/055; A45B 2200/05; A61H 2003/0211; A61H 3/0288; A61H 3/0277; A61H 3/0283; A61H 3/02
See application file for complete search history.

(56) References Cited

U.S. PATENT DOCUMENTS 5,331,989 A 7/1994 Stephens
5,388,673 A * 2/1995 Rohner, III ..... A63C 17/0013 188/5
5,984,359 A 11/1999 Faiks
6,142,526 A * 11/2000 Katz ..... A63C 11/22 135/75
6,474,692 B1 * 11/2002 Farah ..... A63C 17/0013 280/826
7,699,368 B2 * 4/2010 Nicol ..... A62C 33/00 280/47.3

(Continued)

OTHER PUBLICATIONS

BraapStick YouTube, May 9, 2017.

(Continued)

*Primary Examiner* — James M Dolak
(74) *Attorney, Agent, or Firm* — Oyen Wiggs Green & Mutala LLP

(57) ABSTRACT

A device for support and propulsion comprising a shaft, a spring element coupled to the shaft, and a swing arm coupled to the shaft and the spring element. A lower portion of the spring element comprises a ground interface, optionally comprising a wheel.

13 Claims, 4 Drawing Sheets

(56) References Cited

U.S. PATENT DOCUMENTS

| | | | | |
|---|---|---|---|---|
| 7,954,502 | B2 * | 6/2011 | Townsend | A61H 3/02 135/66 |
| 8,465,056 | B2 | 6/2013 | Weir et al. | |
| 8,636,306 | B2 * | 1/2014 | McBride | A63C 17/0013 135/77 |
| 9,498,700 | B2 * | 11/2016 | Henrie | A63C 11/227 |
| 9,586,129 | B2 * | 3/2017 | Henrie | A63C 11/227 |
| 9,763,502 | B2 * | 9/2017 | Rudin | A45B 7/005 |
| 2004/0107981 | A1 | 6/2004 | Smith | |
| 2004/0250845 | A1 | 12/2004 | Rudin et al. | |
| 2012/0015785 | A1 | 1/2012 | Burroughs | |
| 2012/0024634 | A1 | 2/2012 | Walker | |
| 2012/0267872 | A1 | 10/2012 | McBride | |
| 2014/0332045 | A1 | 11/2014 | Rudin | |
| 2016/0229507 | A1 | 8/2016 | Henrie et al. | |

OTHER PUBLICATIONS

BraapStick Facebook, May 9, 2017.
BraapStick Instagram 2, May 9, 2017.
BraapStick Instagram, May 9, 2017.

* cited by examiner

LAND PADDLE

REFERENCE TO RELATED APPLICATIONS

This Application claims priority from U.S. Patent Application No. 62/347,523 filed 8 Jun. 2016 and entitled LAND PADDLE.

TECHNICAL FIELD

The field of the present disclosure includes land paddles and other support and propulsion devices for use with land-based conveyances, such as skateboards, especially longboards, and/or with other wheeled or sliding conveyances, such as wagons, scooters, sleds, or skates. More particularly, the field includes such support and propulsion devices with a spring for absorbing, dampening, storing, and releasing energy between the user and the ground during use of the device while traveling over the ground.

BACKGROUND

Devices for support and propulsion over the ground, such as a land paddle having a handle end and a ground-contact end, have been known to include a shock-absorbing element adjacent the ground-contact end. Such devices have not provided suitable operating characteristics for controlled operation of a longboard. For example, each of the devices described in US Pat. Pubs. Nos. 2012024634 and 2012267872 suffer from the drawback of a generally unconstrained flexing and compressing of the shock-absorbing element in all directions.

There is a general desire for an improved device to provide support and propulsion for use with land-based conveyances, wherein the device stabilizes the user, while storing and releasing energy along the direction of the user's travel.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One or more embodiments of a support and propulsion device according to the present disclosure may combine a shaft having a handle end and a lower end with a spring element coupled to the shaft adjacent the lower end. The shaft may include, adjacent the handle end, a T-shaped handle and/or a grip, such as a rubber sleeve or tape, mounted to the shaft for the user to hold and control the paddle.

Such support and propulsion devices may be used with any wheeled or sliding land-based conveyance, such as a longboard skateboard. One or more embodiments of the present disclosure may make use of a leaf spring attached at one end of a paddle shaft, allowing for energy to be directed into the spring and released to propel the rider forward, while lessening the shock load on the shoulders of the rider when the paddle contacts ground.

One or more embodiments of the present disclosure may make use of a spring element configured to primarily flex within one plane and generally not flex in the dimension perpendicular to the plane. A user may find the operational characteristics of a paddle having such a spring element beneficial for support and propulsion while riding a skateboard, or other ground-traveling conveyance, with improved control of steering, accelerating, slowing, and stopping of the skateboard. This operational characteristic may be best applied with the spring element of the paddle held with its main flexing plane parallel to the skateboard's direction of travel. Alternatively, the user may hold the paddle with the spring element not parallel to the skateboard's direction of travel for various maneuvers of the skateboard, as best suited to the user's control.

One or more embodiments of the present disclosure may be best suited to a casual user, e.g., for touring, while other embodiments may provide advanced lightweight performance, e.g., for racing and/or athletic training programs fitness training. Typically the spring element will be formed of fiberglass and/or carbon fiber or similar resilient materials. Typically the shaft and connecting elements will be formed of carbon fiber, aluminum, or similar hard and preferably lightweight materials. A replaceable rubber sole may be provided on the device at the point of contact with the ground for durable and cost effective operation.

Other embodiments of the present disclosure include a wheel mounted on the lower end of the paddle. The wheel may be configured to rotate in only one direction.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Figure 1:
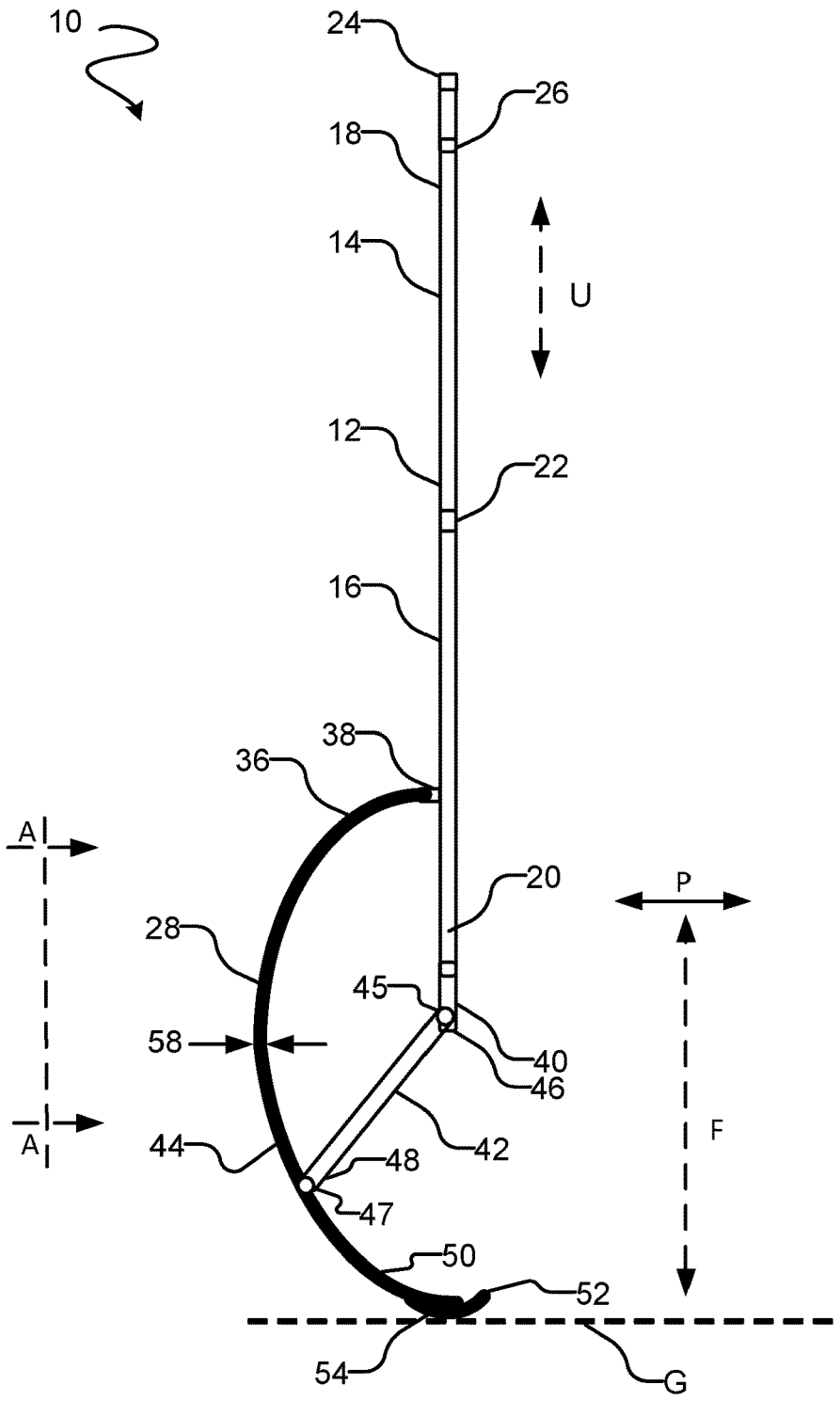
FIG. 1 shows a side view of a propulsion and support device in accordance with the present disclosure, showing a land paddle having a shaft with a handle, a spring element mounted to the shaft adjacent an end opposite the handle, a padded foot at a distal end of the spring element, and a hinged arm extending between an end of the shaft and an intermediate section of the spring element.
Figure 2:
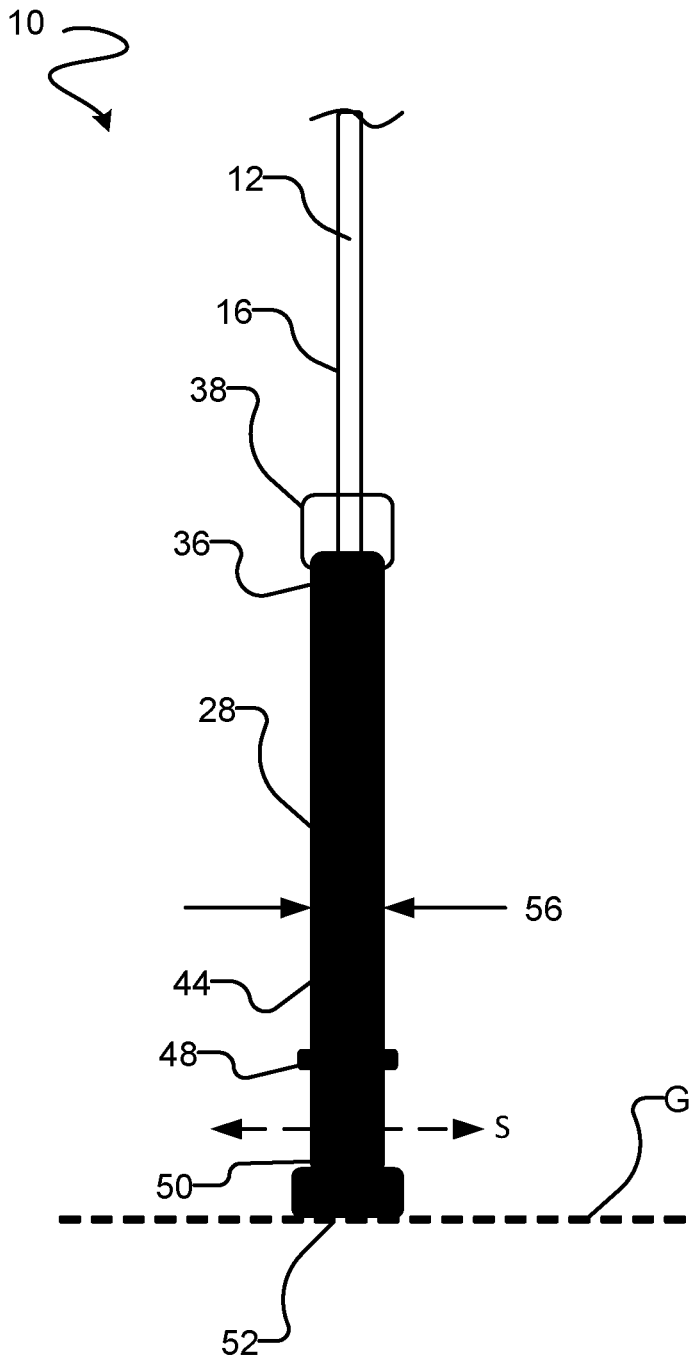
FIG. 2 shows a rear view of a lower portion of the paddle of FIG. 1 showing the lower portion of the shaft, the upper mounting of the spring element to the shaft, and the padded foot of the paddle.

A support and propulsion device in accordance with one embodiment of the present disclosure is shown in FIGS. 1 and 2. Such a device, for example paddle 10, may include a shaft 12 having an upper portion 14 and a lower portion 16 and an upper end 18 and a lower end 20. Shaft 12 may include a coupling 22 between upper portion 14 and lower portion 16. Coupling 22 is typically fixed, or may be releasable or adjustable, e.g. in length and/or in relative orientation to the upper and lower portions. Alternatively, shaft 12 may be formed of a unitary structure. Shaft 12 is typically light weight and substantially rigid over an operating range of the device. Shaft 12 may be formed for example of aluminum or carbon fiber, may be a hollow tube, or use such other material and construction as suited to a particular application of the device.

One or more grip-enhancing structures, such as a T-shaped handle 24, may be attached to shaft 12, typically adjacent upper end 18 and/or in the upper portion 14 of shaft 12, or at any location suited to a use of the device. Handle 24 may be attached by a coupling 26 to shaft 12, providing a fixed, releasable, or adjustable connection to shaft 12. Handle 24 may alternatively by formed integrally with shaft 12. Handle 24 may be a molded one-piece handle of lightweight plastic or other material, or formed of any construction suitable to the particular application of the device.

A spring, such as a C-shaped spring 28, may be coupled to shaft 12, typically adjacent lower end 20 of shaft 12. Spring 28 is typically a leaf spring, for example, or any other flexible, resilient element as suited to a particular application. Spring 28 may flex substantially in a single plane, such as plane P, and be substantially inflexible outside of, or perpendicular to, plane P over the expected operating range of a particular device. Alternatively, spring 28 may be configured to provide for a greater or lesser degree of flexibility perpendicular to plane P, for example as suited to a user's preference.

Spring 28 may include an upper end 36 attached by coupling 38 to lower portion 16 of shaft 12. Coupling 38 may be a fixed coupling, for example, provided by a nut and bolt in through-holes in each of coupling 38 and shaft 12, or may be releasable or adjustable by the user.

An attachment point may be provided adjacent lower end 20 of shaft 12 such as by a metal fitting 40, for mounting a swing arm 42. Swing arm 42 may extend to an intermediate portion 44 of spring 28. Intermediate portion 44 of spring 28 may be any location on spring 28 below the middle of spring 28.

Swing arm 42 may have a first end 46 with a hinged coupling 45 to shaft 12, for example by a nut and bolt. Swing arm 42 may have a second end 48 with a hinged coupling 47 to intermediate portion 44 of spring 28, for example a nut and bolt. Swing arm 42 may be coupled to shaft 12 and spring 28 so that swing arm 42 hinges substantially within plane P, and does not hinge substantially outside of plane P.

Spring 28 may include a lower end 50 having a ground-contact interface, such as foot 52, which may be coupled to spring 28 by any suitable means, such as by one or more nuts and bolts. Foot 52 may be curved and/or padded, for example by a rubber sole 54, or provided with a structure as best suited to a particular application of the device. The configuration of spring 28 may be such that when spring 28 is not compressed, a center of foot 52 is substantially within a plane defined by shaft 12.

As one of ordinary skill in the art will understand, a user, for example a skateboard rider, may hold shaft 12 in one or both hands while standing on a skateboard. The rider may bring foot 52 of paddle 10 into contact with the ground G and apply and release force substantially along the length of shaft 12, as indicated by arrows U. Additionally, the rider will typically be applying torsional and flexing forces to shaft 12. Spring 28 may flex in response to such forces, primarily by compressing and expanding as indicated by arrows F within plane P, and typically to a lesser extent torsionally and by flexing in a plane perpendicular to plane P as shown by arrows S in FIG. 2. Spring 28 may have a width 56, shown in FIG. 2, greater than its depth 58, shown in FIG. 1, to constrain the flexing of spring 28 substantially within plane P as shown by arrows F in FIG. 1, and to minimize side-to-side flexing as indicated by arrows S in FIG. 2, within typical operating ranges of forces applied by the rider.

In some embodiments, one or more of couplings 38, 45 and 47 may be configured to hinge substantially within plane P, and be substantially rigid to movement outside of plane P. For example, one of more of couplings 38, 45 and 47 may comprise a nut and bolt fastened through two or more aligned holes, or a hinge.

Figure 3B:
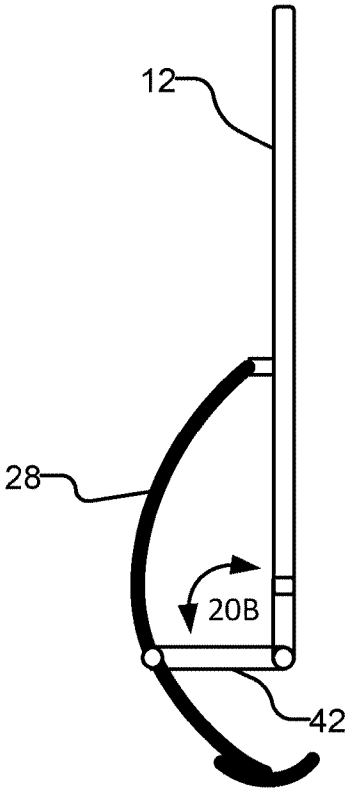
FIGS. 3A and 3B, respectively, show an exemplary embodiment in an uncompressed and a compressed state.
Figure 3A:
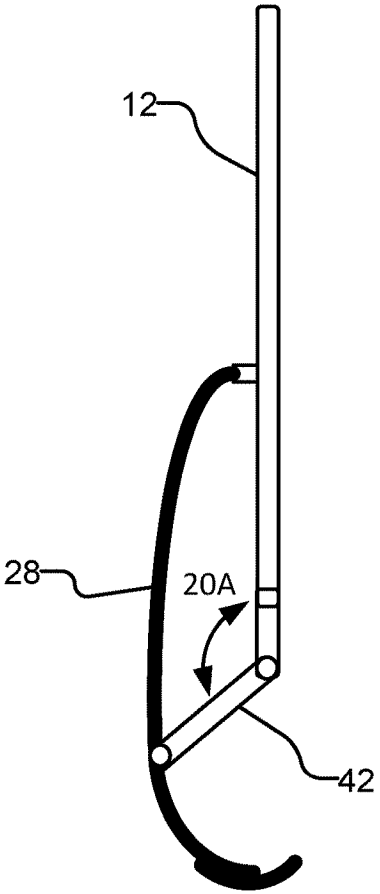

FIGS. 3A shows an example embodiment where swing arm 42 is configured so that an angle 20A between swing arm 42 and shaft 12 is approximately 120 degrees, when spring 28 is uncompressed.

FIG. 3B shows an example embodiment where spring 28 is configured so that an angle 20B between swing arm 42 and shaft 12 is approximately 90 degrees when spring 28 is fully compressed. In alternative embodiments, spring 28 may be configured so that an angle 20B between swing arm 42 and shaft 12 is less than 90 degrees when spring 28 is fully compressed.

Figure 4:
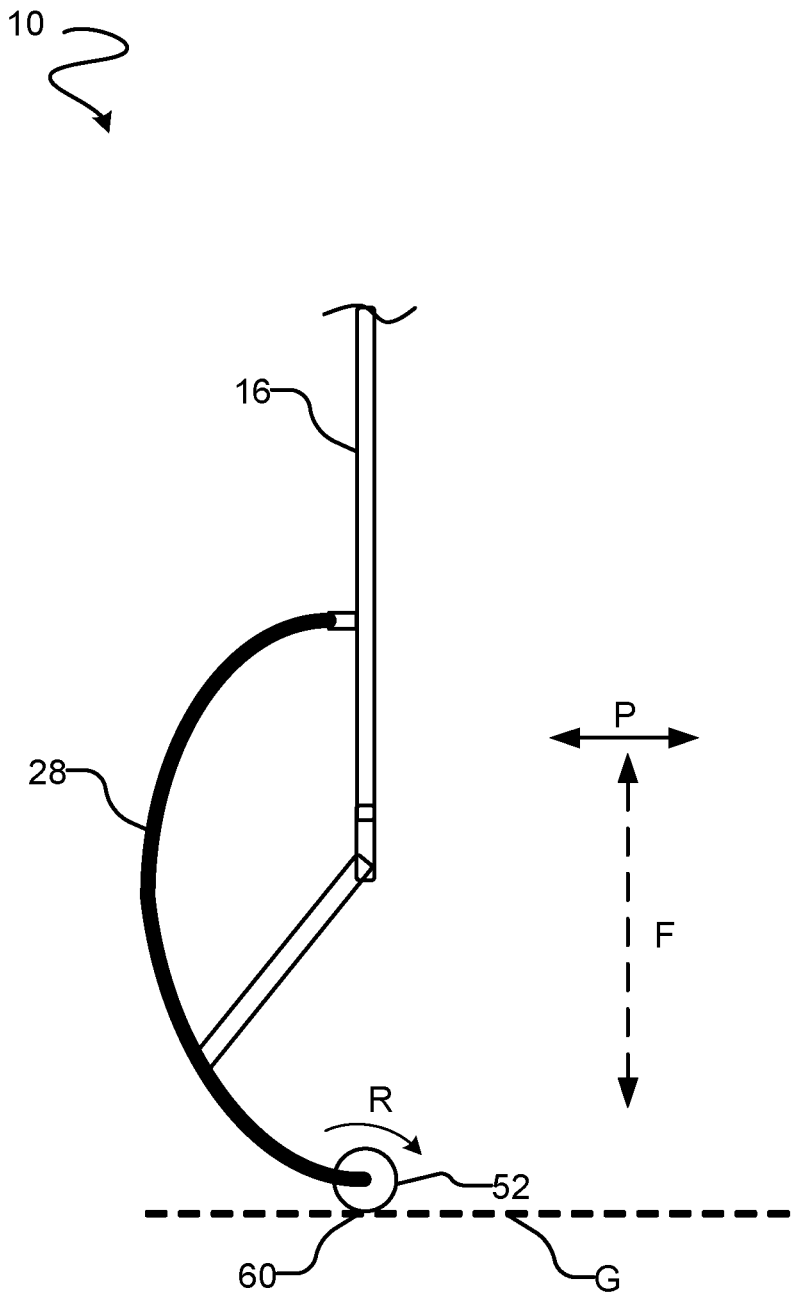
FIG. 4 shows a side view of an alternative embodiment of a propulsion and support device, with a wheel mounted at a distal end of the spring element.

FIG. 4 depicts an alternative embodiment of paddle 10, wherein foot 52 comprises a wheel 60. Wheel 60 may be attached to lower end 50 of spring 28 by any suitable means which allows wheel 60 to rotate relative to spring 28. Wheel 60 is mounted to rotate substantially within plane P, and parallel to the direction in which spring 28 flexes.

In some embodiments, wheel 60 is configured to rotate only in one direction. In these embodiments, wheel 60 may be coupled to spring 28 for example by a directional bearing. Optionally, wheel 60 may be configured to rotate only in a direction R.

In other embodiments, foot 52 may comprise more than one wheel 60.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A land paddle apparatus for support and propulsion, the apparatus comprising:

a shaft comprising an upper portion and a lower portion;

a spring element with an upper and a lower end, the upper end of the spring element coupled to the lower portion of the shaft; and a swing arm comprising an upper end and a lower end, the upper end of the swing arm coupled to the lower portion of the shaft, and the lower end of the swing arm coupled to an intermediate portion of the spring element.

2. The apparatus according to claim 1, wherein the upper end of the spring element is coupled to the lower portion of the shaft above where the upper end of the swing arm is coupled to the lower portion of the shaft.

3. The apparatus according to claim 1, wherein the lower portion of the shaft terminates in a bottom end, and the upper end of the swing arm is coupled to the bottom end of the shaft.

4. The apparatus according to claim 1, wherein the spring element is flexible within a plane defined by the spring element and the shaft, and inflexible outside of the plane.

5. The apparatus according to claim 1, wherein the upper end of the swing arm is coupled to the lower end of the shaft by a coupling which hinges within a plane defined by the spring element and the shaft, and is rigid outside of the plane.

6. The apparatus according to claim 1, wherein the lower end of the swing arm is coupled to the intermediate portion of the spring element by a coupling which hinges within a plane defined by the spring element and the shaft, and is rigid outside of the plane.

7. The apparatus according to claim 1, comprising a wheel rotatably coupled to the lower end of the spring element.

8. The apparatus according to claim 7, wherein the wheel is rotates in only one direction.

9. The apparatus according to claim 8, wherein the wheel is coupled to the lower end of the spring element by a directional bearing.

10. The apparatus according to claim 1, wherein the spring element is a C-shaped spring.

11. The apparatus according to claim 1, wherein the spring element is a leaf spring.

12. The apparatus according to claim 1, wherein the spring element has a width perpendicular to a plane defined by the spring element and the shaft, and the spring element has a depth parallel to the plane that is less than the width of the spring element.

13. The apparatus according to claim 1, wherein the lower end of the spring element comprises a padded foot.

* * * * *